US012281547B2

(12) United States Patent
Prisbell et al.

(10) Patent No.: US 12,281,547 B2
(45) Date of Patent: Apr. 22, 2025

(54) PERFORATION TOOL WITH PROPULSION

(71) Applicant: SCHLUMBERGER TECHNOLOGY CORPORATION, Sugar Land, TX (US)

(72) Inventors: Andrew Prisbell, Sugar Land, TX (US); Atsushi Nakano, Sugar Land, TX (US); Hari Prakash Kalakonda, Andhra Pradesh (IN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/475,806

(22) Filed: Sep. 27, 2023

(65) Prior Publication Data

US 2024/0018852 A1 Jan. 18, 2024

Related U.S. Application Data

(63) Continuation of application No. 17/654,608, filed on Mar. 14, 2022, now Pat. No. 11,781,403.

(60) Provisional application No. 63/160,456, filed on Mar. 12, 2021.

(51) Int. Cl.

| | |
|---|---|
| ***E21B 43/117*** | (2006.01) |
| ***E21B 23/00*** | (2006.01) |
| ***E21B 43/119*** | (2006.01) |

(52) U.S. Cl.

CPC ..... *E21B 43/117* (2013.01); *E21B 23/001* (2020.05); *E21B 43/119* (2013.01)

(58) Field of Classification Search

CPC .... E21B 23/001; E21B 43/119; E21B 43/117; E21B 23/14; E21B 34/14; E21B 23/00

See application file for complete search history.

(56) References Cited

U.S. PATENT DOCUMENTS

| | | | | |
|---|---|---|---|---|
| 9,528,354 | B2 | 12/2016 | Loiseau | |
| 2005/0269083 | A1 | 12/2005 | Burris | |
| 2013/0319661 | A1 | 12/2013 | Xiao | |
| 2014/0311755 | A1 | 10/2014 | Al-Badran | |
| 2016/0251941 | A1 | 9/2016 | Murphree | |
| 2018/0128083 | A1 | 5/2018 | Lastra | |
| 2019/0284889 | A1* | 9/2019 | Lagrange | E21B 47/04 |
| 2019/0316433 | A1* | 10/2019 | Schroit | F04B 53/00 |
| 2020/0199957 | A1* | 6/2020 | Bertoja | E21B 23/00 |

OTHER PUBLICATIONS

International Search Report and Written Opinion issued in International Patent application PCT/US2022/071116 dated Jun. 16, 2022, 10 pages.

International Preliminary Report on Patentability issued in International Patent application PCT/US2022/071116 dated , dated Sep. 21, 2023, 7 pages.

* cited by examiner

*Primary Examiner* — Yong-Suk (Philip) Ro

(74) *Attorney, Agent, or Firm* — Jeffrey D. Frantz

(57) ABSTRACT

A perforation assembly includes a perforation tool and a propulsion unit coupled to the perforation tool, the propulsion unit comprising an impeller and a protective structure disposed around the impeller.

20 Claims, 6 Drawing Sheets

PERFORATION TOOL WITH PROPULSION

CROSS-REFERENCE TO RELATED APPLICATIONS

This patent application is a continuation of U.S. patent application Ser. No. 17/654,608, filed Mar. 14, 2022, which claims the benefit of U.S. Provisional Patent Application Ser. No. 63/160,456 filed Mar. 12, 2021. Each of the above applications is entirely incorporated by reference herein.

FIELD

Perforation tools and components used in hydrocarbon production are described herein. Specifically, new perforation tools with propulsion systems are described.

BACKGROUND

Perforation tools are tools used in oil and gas production to form holes, passages, and/or fractures in hydrocarbon-bearing geologic formations to promote flow of hydrocarbons from the formation into the well for production. The tools generally have explosive charges shaped to project a jet of reaction products, including hot gases and molten metal, into the formation. The tool has a generally tubular profile, and includes support frames, ignition circuits, and potentially wiring for activating the charges and communicating signals and/or data along the tool.

Perforation tools are deployed into a wellbore to add fracturing to a geologic formation. The wellbore is frequently full of fluid for at least part of its length, requiring that the perforation tool be deployed through the column of fluid to its desired location. The fluid generally offers resistance to movement of the perforation tool through the wellbore due to buoyancy and fluid drag effects. Conventionally, a tool string supporting a perforation tool is propelled downhole using large surface equipment. As perforation tools are reduced in weight through use of lighter, lower density materials, fluid drag and buoyancy effects become more pronounced. There is a need for an improved method and apparatus for deploying perforation tools.

SUMMARY

Embodiments described herein provide a perforation assembly, comprising a perforation tool; and a propulsion unit coupled to the perforation tool, the propulsion unit comprising an impeller and a protective structure disposed around the impeller.

Other embodiments described herein provide a perforation assembly, comprising a plurality of perforation tools; and a plurality of propulsion units coupled to the perforation tool, each perforation tool comprising an impeller and a protective structure disposed around the impeller, wherein each protective structure includes one or more electrical conductors to provide electrical continuity across the propulsion unit.

Other embodiments described herein provide a perforation assembly, comprising a perforation tool; a propulsion unit coupled to the perforation tool, the propulsion unit comprising an impeller and a protective structure with a tapered shape disposed around the impeller; and a flow improvement structure disposed between the perforation tool and the propulsion unit.

Other embodiments described herein provide a method of treating a subterranean formation, the method comprising disposing a perforation tool comprising a propulsion unit having a protective cage around at least a portion thereof within a well formed in the formation; operating the propulsion unit without attachment of a service line to position the perforation tool within the well; and operating the perforation tool to perforate the well

DETAILED DESCRIPTION

The perforation tools and assemblies described herein use rotary propulsion units to simplify deployment of the perforation tool at a designated location in a well. The rotary propulsion units have a rotatable member to generate thrust in a fluid medium. The propulsion units may have variable drive characteristics that can be used to adjust the speed of motion, and some perforation tool assemblies might have two propulsion units for forward and reverse propulsion. Different types of propulsion units can be used, and the propulsion units may be powered by surface power sources, or by a combination of local and surface power sources.

Figure 1:
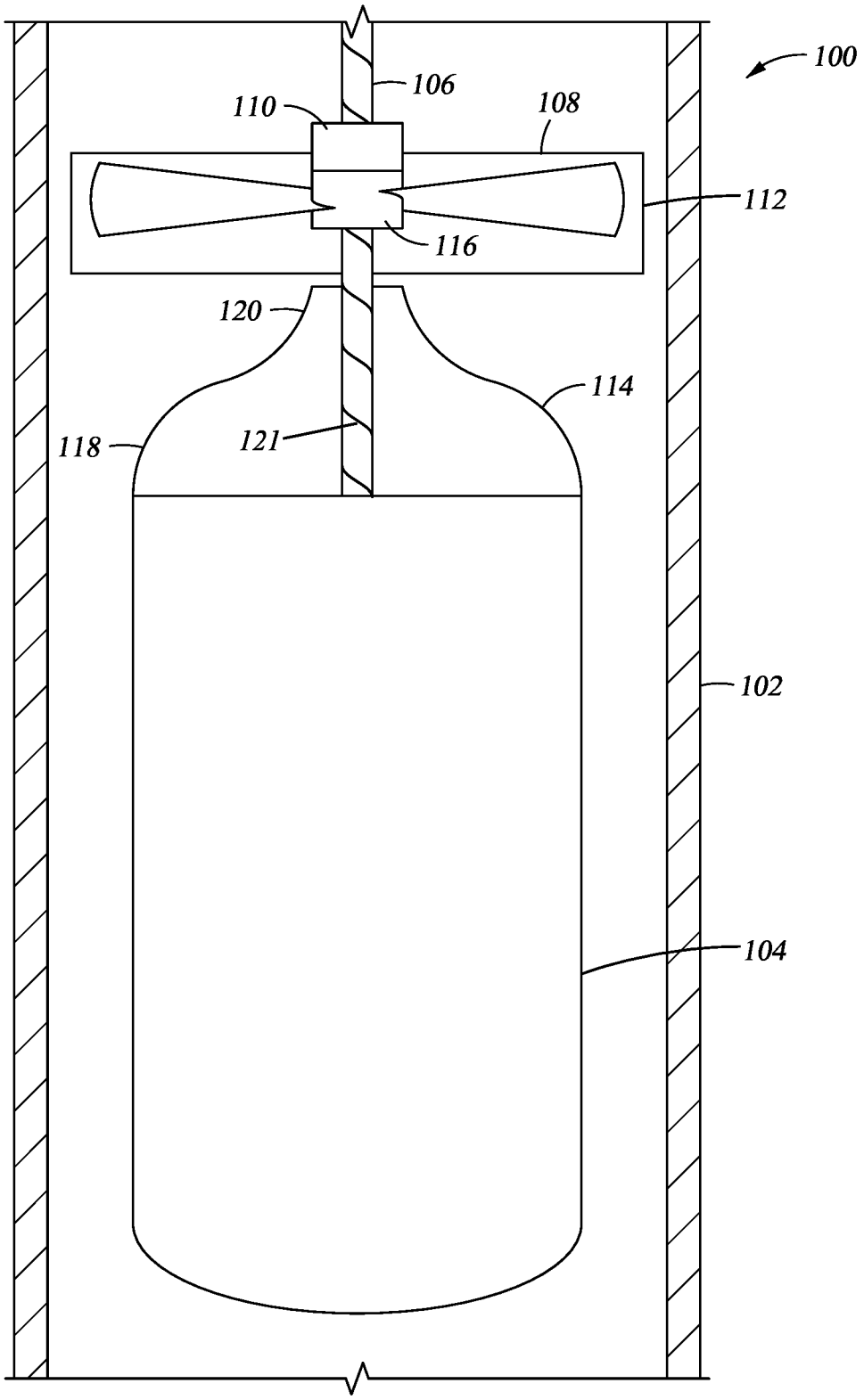
FIG. 1 is a side view of a perforation assembly with a propulsion unit according to one embodiment.

FIG. 1 is a schematic cross-sectional view of a perforation assembly 100 that has a rotary propulsion unit 108. The perforation assembly 100 is shown deployed in a well 102 to show the configuration of the assembly 100 in operation. The perforation assembly 100 has a perforation tool 104 connected to a service line 106. The service line 106 may be a cable or cable bundle, and may be housed in a conduit, which may be a tube or pipe. The propulsion unit 108 has a motor 110 coupled to an impeller 116. The impeller 116 is enclosed in a protective structure 112 that prevents the impeller 116 from contacting the wall of the well 102. The protective structure 112 may also prevent solid material in the well, such as rocks and sand, from impeding function of the propulsion unit 108. The protective structure 112 may be a cage, for example a mesh cage, or a plurality of elongated members disposed around the impeller 116. For example, three elongated members may extend around the impeller 116.

The service line 106 extends through the motor 110 and the impeller 116 to connect to the perforation tool 104. The motor may be powered by an electrical connection in the service line 106. A flow improvement structure 114 may be disposed between the propulsion unit 108 and the perforation tool 104. In a liquid-filled well segment, which may be vertical, horizontal, or any orientation between, movement of the perforation tool through the liquid will generate movement of the liquid, which may be turbulent. Turbulent inflow to the propulsion unit 108 can reduce propulsive efficiency, defined as thrust per unit power consumed. The flow improvement structure 114 can be used to reduce turbulence at the inflow of the propulsion unit 108, increasing propulsive efficiency. The flow improvement structure 114 is shown here as a curved cowl with a wide end 118 and a narrow end 120. The wide end 118 has a diameter substantially similar to a diameter of the perforation tool 104 and is located proximate to, or even in contact with, the perforation tool 104. The narrow end 120 has a diameter smaller than the diameter of the wide end 118 to smooth flow into the propulsion unit 108. The exact shape of the flow improvement structure 114 can be derived and optimized to any desired extent. The shape shown here is a generally curved shape from the wide end 118 to the narrow end 120, and any curve can be used. The flow improvement structure 114 can also have a tapered linear profile, like a frustoconical shape.

The impeller 116 is shown here as a fan shape, but any suitable impeller can be used. Pitch, number of blades, blade curvature in various directions can be applied. It should be noted that one impeller 116 is shown here in the propulsion unit 108, but any number of impellers 116 could be used in a propulsion unit. Where multiple impellers 116 are used in a propulsion unit, suitable spacing may be employed between the impellers 116 to stabilize flow for maximum propulsive efficiency of each impeller. The motor 110 is shown here mostly outside the protective structure 112, but the motor can be located inside the protective structure 112.

The propulsion unit 108 is generally sized to maximize thrust cross-section within the well 102. Thus, the diameter of the protective structure 112 is sized to approach the inner diameter of the well 102. While some contact between the protective structure 112 and the well inner wall can be tolerated, too much contact can cause resistance to movement of the perforation tool 104 within the well 102. Depending on the nature of the well wall, the protective structure 112 can be sized to have an outer diameter 5 cm less than the inner diameter of the well 102, or less, for example down to 1 cm or even 0.5 cm less than the inner diameter of the well 102. The protective structure 112 can also have flow improvement features, such as tapers, channels, and baffles in any convenient arrangement.

Rotation of the impeller 116 by the motor 110 can produce torque on the service line 106 that may tend to rotate the perforation tool 104. If multiple propulsion unit 108 or multiple impellers 116 are used, the multiple units can be configured to counter-rotate to minimize or eliminate twist. Thus, a first propulsion unit, or portion of a plurality of propulsion units, can be configured to provide thrust in a thrust direction when rotated in a first direction, while a second propulsion unit, or portion of the plurality of propulsion units, can be configured to provide thrust in the thrust direction when rotated in a second direction opposite from the first direction. Alternately, anti-twist features can be incorporated into the service line 106. For example, in one case, as shown in FIG. 1, the service line 106 can have an external helical ridge 121 formed thereon as an anti-twist feature. Height, thickness, and pitch of the helical ridge 121 can be adjusted to optimize torsional rigidity and handling by surface equipment. Vanes can also be added to the exterior of the perforation tool 104 or the protective structure 112 to counteract torque. For example, vanes can be formed on the exterior of the dust cap at the front of the perforation tool to provide counter-rotational force in fluid flow.

Figure 2:
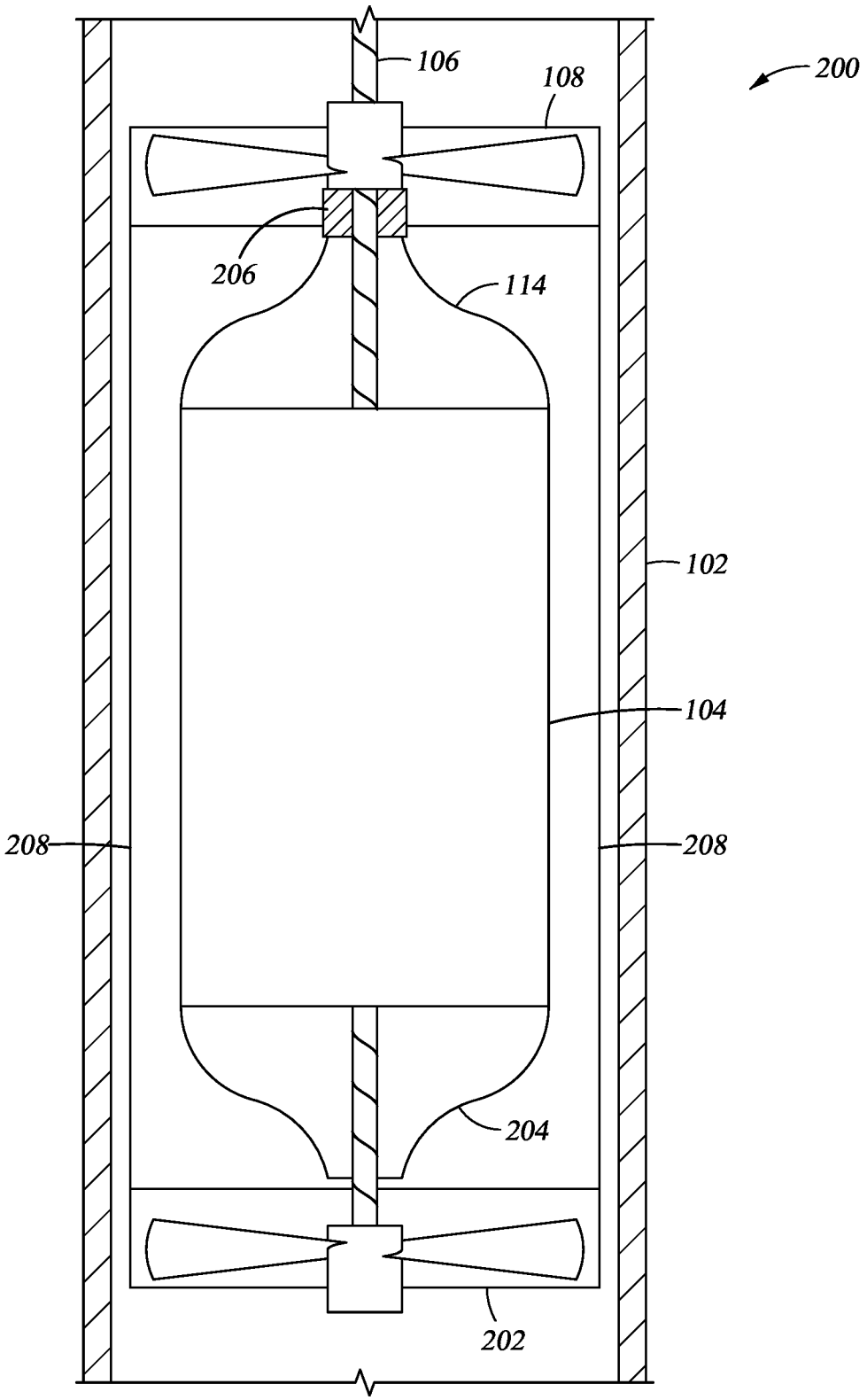
FIG. 2 is a side view of a perforation assembly with a propulsion unit according to another embodiment.

FIG. 2 is a schematic cross-sectional view of a perforation assembly 200 with two propulsion units according to another embodiment. This example has a first propulsion unit 108 on a first side of the perforation tool 104 and a second propulsion unit 202 on a second side of the propulsion unit 108, opposite from the first side. A flow improvement structure is positioned at each side of the perforation tool 104. A first flow improvement structure 114 is positioned at the first side of the perforation tool 104 and a second flow improvement structure 204 is positioned at the second side of the perforation tool 104. In each case, the wide end of the flow improvement structure is proximate to the perforation tool 104 and the narrow end of the flow improvement structure is oriented toward the propulsion unit. Here, where two propulsion units are used, the propulsion units 108 and 202 can be configured to counter-rotate. The optional anti-twist feature is also shown on the service line 106. Optional rigid connectors 208 can also be connected between the protective structures of the two propulsion units 108 and 202 to reduce twisting. It should be noted that the flow improvement structures can be the same or different. For example, the "upstream" flow improvement structure 204, in this case, could be longer in an axial direction than the "downstream" flow improvement structure 114 to streamline the thrust envelope of the "upstream" flow improvement structure 204.

The perforation assembly 200 may include a spacer 206 between the perforation tool 104 and the propulsion units 108 and/or 202. Here, one spacer 206 is shown between the downstream flow improvement structure 114 and the rear propulsion unit 108. The spacer 206 can be used to provide flow stabilization for fluids between the perforation tool 104 and the rear propulsion unit 108. The spacer 206 can also be used to reduce the effect of discharging the perforation tool 104 on the propulsion unit 108 by increasing distance between the perforation tool and the propulsion unit. Note that a spacer can be used in the perforation assembly of FIG. 1, having only one propulsion unit, or in any of the perforation assemblies described herein.

Figure 3:
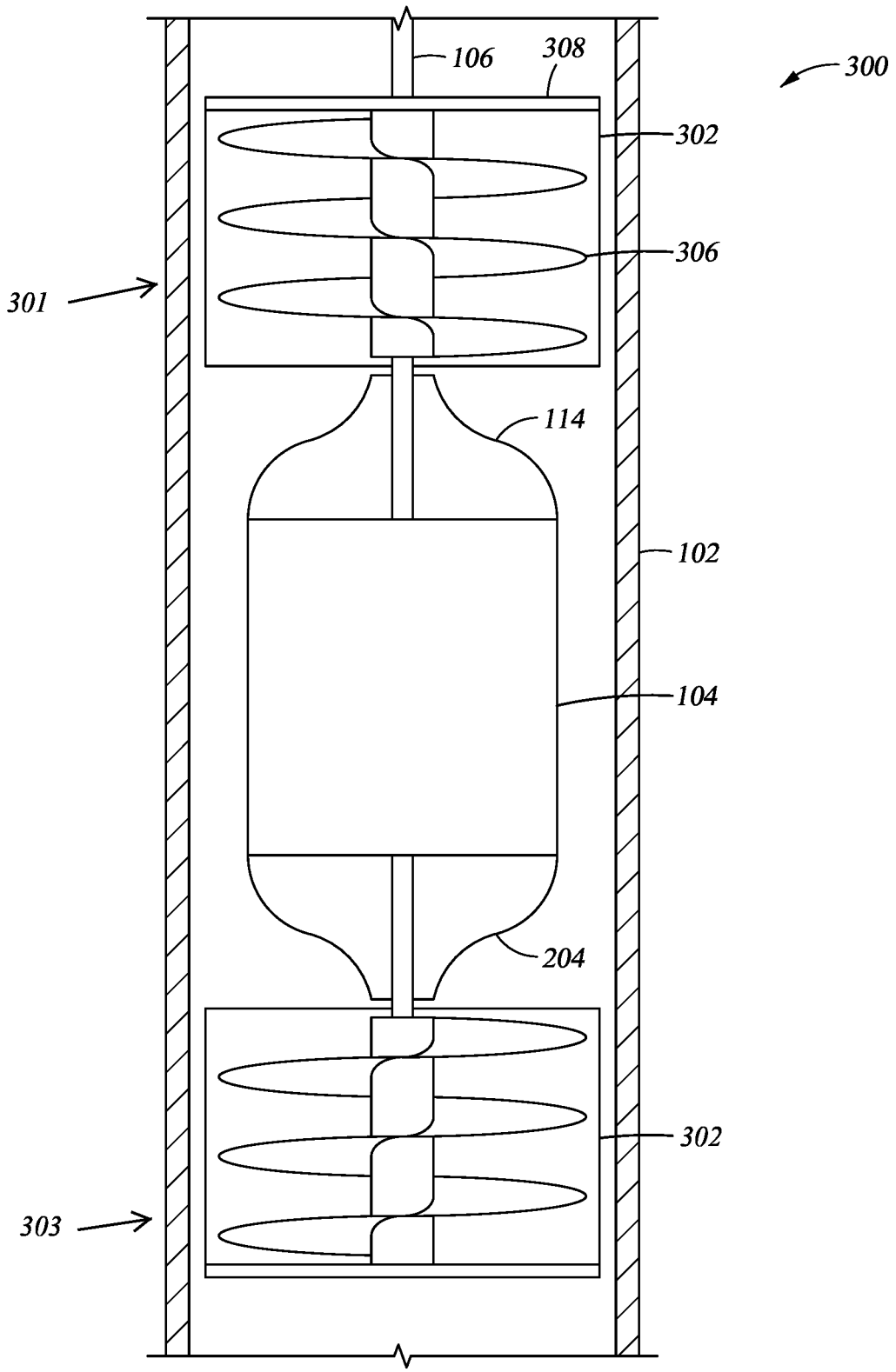
FIG. 3 is a schematic cross-sectional view of a perforation assembly according to another embodiment.

FIG. 3 is a schematic cross-sectional view of a perforation assembly 300 according to another embodiment. The perforation assembly 300 of FIG. 3 features two propulsion units, a first propulsion unit 301 and a second propulsion unit 303. Each of the propulsion units 301 and 303 has a screw impeller 306 coupled to a motor unit 308. Each motor unit 308 may be powered by wires from the surface disposed within the service line 106. Additionally, or alternately, each motor unit 308 may have a battery unit or other local power unit (fuel cell, etc.) to power the propulsion unit. In this case, the first flow improvement structure 114 and the second flow improvement structure 204 are used as before, the two propulsion units may counter-rotate (using impellers of appropriate handedness), and an anti-twist feature may be applied to the service line 106, as in the other embodiments. A protective structure 302 is disposed around each impeller 306. Using screw impellers can improve propulsive efficiency, and screw characteristics such as length, pitch, starts, and the like, can be optimized. Use of two propulsion units on either side of a tool can improve bi-directional movement of the tool down-hole.

Figure 4:
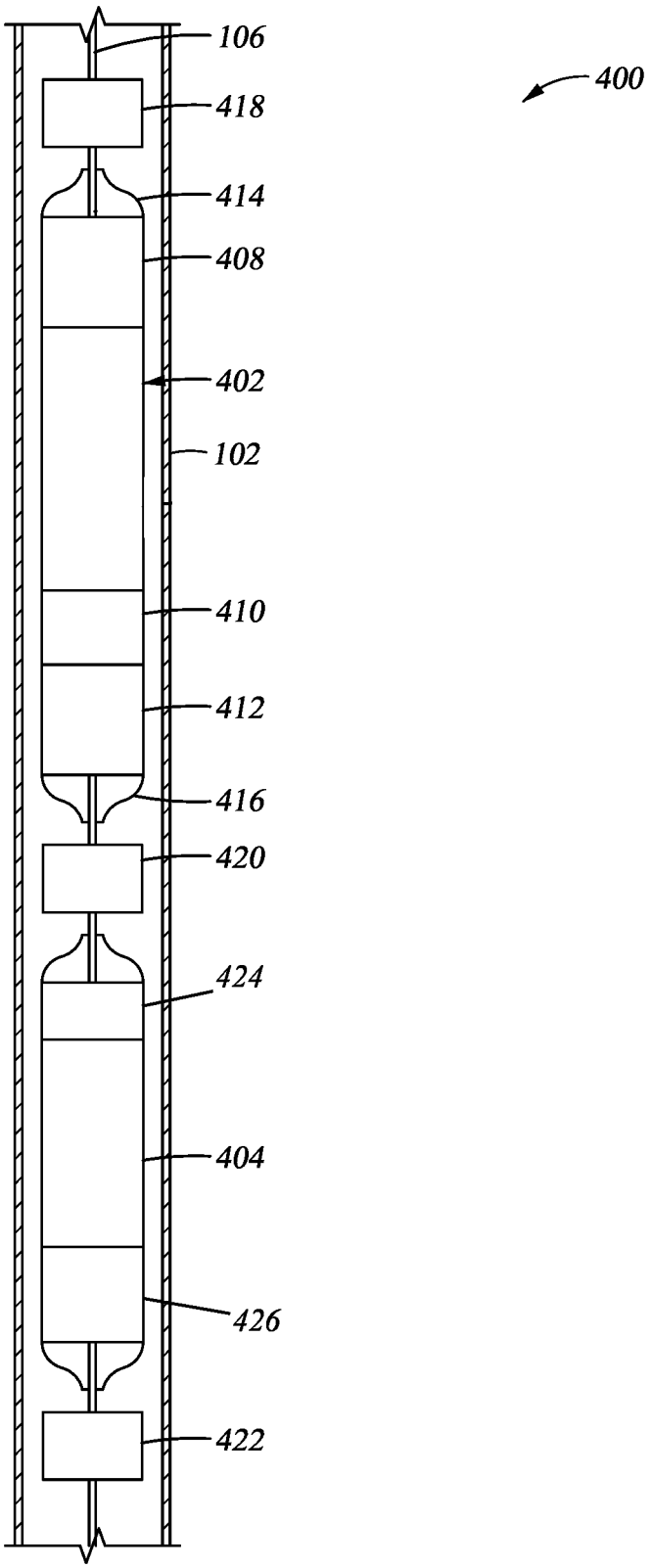
FIG. 4 is a schematic cross-sectional view of a perforation assembly according to another embodiment.

FIG. 4 is a schematic cross-sectional view of a perforation assembly 400 according to another embodiment. The perforation assembly 400 has two perforation tools, a first perforation tool 402 and a second perforation tool 404. The perforation assembly 400 also has a plurality of propulsion units. Here, there are three propulsion units, a first propulsion unit 418, a second propulsion unit 420, and a third propulsion unit 422. The first and third propulsion units 418 and 422 are at the ends of the perforation assembly 400, such that the perforation tools 402 and 404 are between the first and third propulsion units 418 and 422. The second propulsion unit 420 is between the perforation tools 402 and 404. The three propulsion units 418, 420, and 422 provide sufficient propulsive thrust to move the perforation assembly 400 in either direction within the well.

Each of the propulsion units 418, 420 and 422, can have a screw-type or fan-type impeller, and each of the propulsion units 418, 420, and 422, can independently be powered by surface sources or by local sources such as battery units. One battery unit can power more than one of the propulsion units 418, 420, and 422, or each propulsion unit can have its own battery unit.

The perforation assembly 400 has spacer units to move the propulsion units away from the perforation tools to reduce impact of discharging the perforation tools on the propulsion units. A first spacer unit 408 is located between the first perforation tool 402 and the first propulsion unit 418. A second spacer unit 412 is located between the first perforation tool 402 and the second propulsion unit 420. A third spacer unit 424 is located between the second perforation tool 404 and the second propulsion unit 420. A fourth spacer unit 426 is located between the second perforation tool 404 and the third propulsion unit 422. Spacer units are located on each side of each perforation tool 402 and 404 to reduce propagation of ballistic discharge to the propulsion units on either side of each perforation tool.

A flow improvement structure is located on each side of each perforation tool to streamline fluid flow into and out of the propulsion units. Here, each propulsion unit has flow improvement structures at either end. So, the first propulsion unit 418 has a first flow improvement structure 414 at a first end and a second flow improvement structure 416 at a second end, opposite from the first end. The flow improvement structures 414 and 416 are oriented in opposite directions so that the wide end of each flow improvement structure is adjacent to the perforation tool and the narrow end of each flow improvement structure is spaced away from the perforation tool. Streamlining fluid flow into and out of the propulsion units can improve propulsive efficiency. Propulsive efficiency can be an important part in reducing energy consumption by the propulsion units, particularly for battery-powered units. In each case, the wide end of the flow improvement structure is disposed against the perforation tool and the narrow end, opposite from the wide end, points toward a propulsion unit.

It should be noted that the propulsion units can be independently operated to accomplish a desired movement of the perforation assembly 400. The propulsion units can be configured to counter-torque to reduce any twisting of the perforation assembly, and as before the service line 106 can be provided with anti-twist features described elsewhere herein (not shown in FIG. 4).

A communication unit 410 can be included with the perforation assembly 400 to communicate control signals to the various components of the perforation assembly 400 and the communicate data from sensors that may be disposed at any location within the perforation assembly 400. The communication unit 410 may operate by wired or wireless connection and may include a controller to signal operation of the propulsion units 418, 420, and 422, and operation of the perforation tools 402 and 404.

The perforation assemblies described herein support a method of perforating a subterranean formation that includes use of a perforation assembly having a propulsion assembly. A perforation assembly comprising one or more perforation tools and one or more propulsion units is lowered into a well. The well may have a casing deployed or may be free of casing. Typically, the well will have some fluid that has moved from the subterranean formation into the hole. The location of the fluid interface may be known or unknown. The perforation assembly is lowered until no further progress can be made in extending the perforation assembly into the well.

At that time, the one or more propulsion units is activated. The propulsion units may be powered locally, for example by battery units or other local power units, or the propulsion units may be powered by wired connection to surface power supplies. Power is engaged to the one or more propulsion units, which are engaged in a forward mode to extend the perforation assembly into the formation. Sensors monitor location of the one or more perforation tools, and signal location of the one or more perforation tools to a controller, which may be local to the perforation tool or may be located at the surface.

When a sensor signals a location of a perforation tool that is within a tolerance of a target location, power to the propulsion units is disengaged. If necessary to maintain position of the one or more perforation tools at a desired location for a period of time, power can be engaged to the propulsion units, and the propulsion units can be controlled by the controller to perform station keeping. The rate at which the perforation assembly is extended into the formation can be controlled by adjusting power to the propulsion units. The units described herein have variable speed motors that can be adjusted by increasing or decreasing power to the motors. As the location of a perforation tool approaches a desired location, for example, the propulsion units can be slowed by reducing power so that the perforation tools can be precisely located.

In a typical perforation operation, multiple perforation tools are discharged at different locations in a well. The perforation assembly is lowered to a starting point within the well and then retracted. As the perforation assembly is retracted, perforation tools reach target discharge locations, as measured by sensors in the perforation assembly, and the perforation tools are discharged at their target locations. Movement of the perforation assembly can be stopped while a perforation tool is discharged, or the tool can be discharged as the assembly is retracted without stopping. The propulsion units described herein can be used to perform, or assist with, retracting a perforation assembly to discharge perforation tools in the assembly. The propulsion units can be energized in a reverse mode to provide movement toward the surface location of the well at a controlled rate so that the perforation tools can be discharged precisely at their target locations.

It should be noted that, with wireless communication and local power sources, a perforation assembly can be deployed and operated without any wired connection to the surface. A perforation assembly with one or more perforation tools, propulsion units, sensor units, communication units, and processing units, can autonomously move through a well to a target location sensed by the sensor units and ascertained by the processing units by operating the propulsion units, in forward and/or reverse mode, to approach and arrive at the target location. The processing units can operate untethered to any surface equipment and/or independent of any surface equipment or wire connection to surface equipment. The processing units can autonomously discharge the perforation tools, and the assembly can return to the surface, or at least to the location of the fluid surface within the well, where a surface apparatus can retrieve the perforation assembly.

Figure 5A:
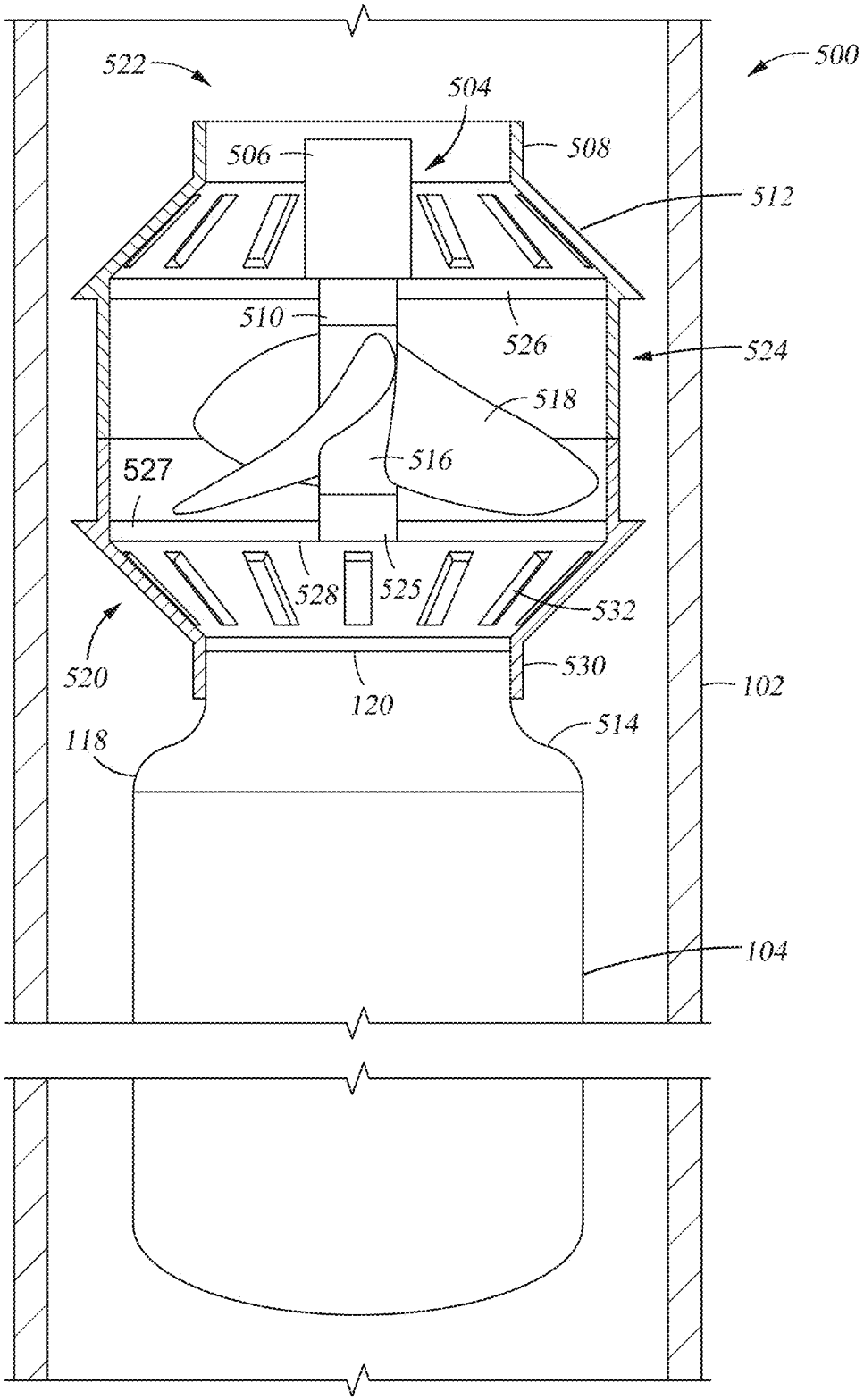
FIG. 5A is a schematic cross-sectional view of a perforation assembly according to another embodiment.

FIG. 5A is a schematic cross-sectional view of a perforation assembly 500 according to another embodiment. The perforation assembly 500 includes the perforation tool 104 and has a propulsion unit 508 of a different design. In this case, the entire perforation assembly 500 is autonomous, with no service line attached. The propulsion unit 508 has a motor 510 powered by a battery unit 506. An impeller 516 has a plurality of blades 518, in this case three blades 518 but any number can be used of any convenient design. The impeller 516 is coupled to the motor 510 by a rotor, which is not visible in FIG. 5A. The motor 510 and battery unit 506 constitute a power unit 504 for the propulsion unit 508. The propulsion unit 508 may also have a communication unit, not shown here, that can be powered by the battery unit 506, or by another battery unit dedicated solely to the communication unit. The communication unit can be a wireless unit that can communicate with surface communication units and/or repeaters positioned within the well bore 102. Other units, such as sensor units and processing units, can also be housed with, or within, the propulsion unit 508.

The propulsion unit 508 has a protective structure 512 with a tapered profile and slotted ends. The protective structure 512 has a head portion 520, a tail portion 522, and a body portion 524 between the head portion 520 and the tail portion 522. The head portion 520 and the tail portion 522 are tapered for fluid drag reduction, and the body portion 524 is sized to contain the impeller 516. One or more support members 526 may be attached between the power unit 504 and the protective structure 512, in this case between the motor 510 and the tail portion 522 but any connection points could be used. An optional rotor support 528 can be provided at an end of the impeller 516 opposite from the power unit 504 to stabilize the impeller 516. The rotor support 528 can engage with the rotor and can connect to the protective structure 512, in this case at the head portion 520. The rotor support 528 has a hub portion 525 that engages with the rotor and a plurality of arm portions 527 that extend radially outward from the hub portion 525 to connect to the protective structure 512.

The body portion 524 is a cylindrical member, and the head and tail portions 520 and 522 are tapered, in this case each having a conical profile. Each of the head and the tail portions 520 and 522 has an annular collar 530 that can be used for attachment to other members. For example, as shown in FIGS. 5A (and 5B), the collar 530 of the head portion 520 can engage with a flow improvement structure 514 designed with a narrow end 120 that fits inside the collar 530. Each of the head portion 520 and the tail portion 522 has a plurality of slots 532 to provide fluid flow pathways through the protective structure 512. The slots 532 have long axes oriented along an axial direction of the perforation assembly 500, and the slots 532 are distributed uniformly around the circumference of the head and tail portions 520 and 522, respectively. Any number of slots 532 can be provided, having any convenient size. The protective structure 512 is shown here as an integral unit, but the head portion 520, body portion 524, and tail portion 522 can each be a separate piece, all fastened together to form the protective structure 512.

Figure 5B:
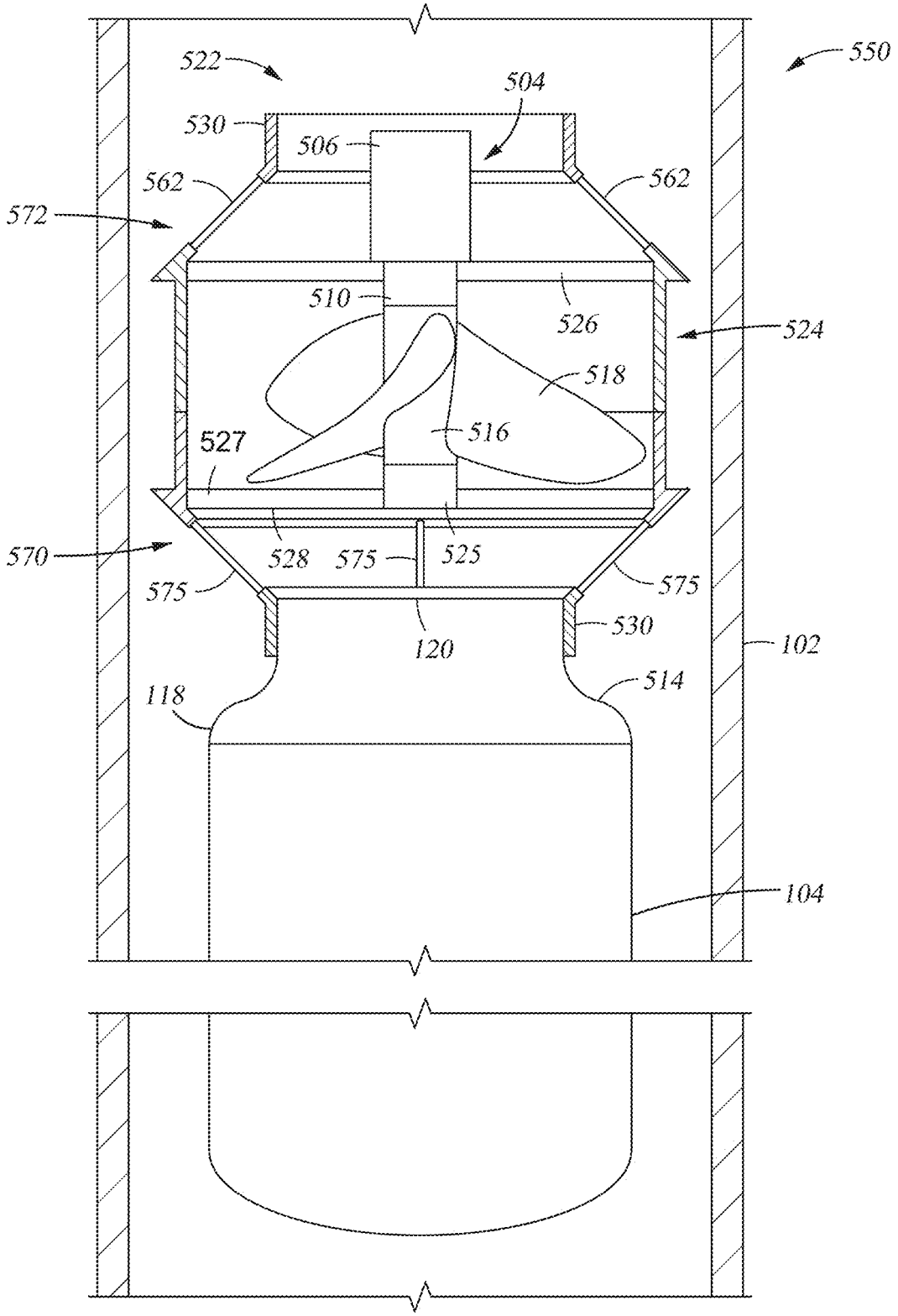
FIG. 5B is a schematic cross-sectional view of a perforation assembly according to another embodiment.

FIG. 5B is a schematic cross-sectional view of a perforation assembly 550 according to another embodiment. The perforation assembly 550 is similar to the perforation assembly 500 of FIG. 5A but has a different protective structure 562. In FIG. 5B, the protective structure 562 has a head portion 570 and tail portion 572 that are open, with only rods 575, or similar connectors, connecting the collar 530 to the body portion 524. Instead of a slotted conical member, as in the protective structure 512 of the perforation assembly 500, the protective structure 562 has a more open flow path through the head portion 570 and the tail portion 572. Such an open flow path can improve thrust efficiency of the propulsion unit. It should be noted, with respect to the protective structures 512 and 562 of FIGS. 5A and 5B, that the collars 530 can be omitted if no attachment or engagement with another downhole unit is needed. So, for example, if no other tool or unit is to be engaged with the tail portions 522 or 572 in FIGS. 5A and 5B, the collar 530 of the tail portion can be omitted.

If desired, rudder features, or vanes as described above, can be added to the tail portions 522 or 572 to provide axial stability for the perforation assemblies 500 and 550, to counteract axial rotation of the assemblies. Vanes or rudder features can also be added to the propulsion tool, as described above, to counteract rotation.

As described elsewhere herein, the perforation tools described herein can be used to treat subterranean formations without attachment of a service line. A perforation tool having a propulsion unit, which can have a protective structure around at least a portion thereof, is disposed within a well formed in the formation. The perforation tools described above can all be used and can have any suitable protective structure around portions that can be damaged by debris in the well or by contact with well walls. The propulsion unit is operated to position the perforation tool within the well. Sensors and processors, suitably configured, can be included in the perforation tool and/or the propulsion unit to guide positioning of the perforation tool. As necessary, the perforation tool can be moved in a "forward" or "backward" direction by energizing the propulsion unit to accomplish such movement. Upon reaching a target location for operation of the perforation tool, the perforation tool is then activated to perforate the well. In some cases, following activation of the perforation tool, the propulsion unit can be operated to bring the perforation tool to the surface for retrieval.

While the foregoing is directed to embodiments of the present invention, other and further embodiments of the present disclosure may be devised without departing from the basic scope thereof, and the scope thereof is determined by the claims that follow.

We claim:

1. A perforation assembly comprising:

a perforation tool;

a first propulsion unit coupled to the perforation tool at a first end of the perforation tool and configured to provide a first thrust to the perforation assembly in a desired direction; and a second propulsion unit coupled to the perforation tool at a second end of the perforation tool and configured to provide a second thrust to the perforation assembly in the desired direction, wherein the first propulsion unit and the second propulsion unit are configured to operate independently and at the same time to provide the first thrust and the second thrust, respectively, to the perforation assembly in the desired direction.

2. The perforation assembly of claim 1, comprising a controller configured to:

receive an indication of a location of the perforation tool; and cause the first propulsion unit to activate to provide the first thrust to the perforation assembly in the desired direction, or the second propulsion unit to activate to provide the second thrust to the perforation assembly in the desired direction, or a combination thereof.

3. The perforation assembly of claim 2, comprising one or more sensors configured to monitor the location of the perforation tool, and wherein the controller is configured to receive the indication of the location of the perforation tool from the one or more sensors.

4. The perforation assembly of claim 1, wherein the perforation tool is a first perforation tool, and wherein the perforation assembly further comprises a second perforation tool and a third propulsion unit coupled to the second perforation tool at a first end of the second perforation tool.

5. The perforation assembly of claim 4, wherein the second propulsion unit is coupled to the second perforation tool at a second end of the second perforation tool.

6. The perforation assembly of claim 4, comprising a controller configured to:

receive an indication of a location of the first perforation tool, or the second perforation tool, or both; and cause the first propulsion unit to activate to provide the first thrust to the perforation assembly in the desired direction, the second propulsion unit to activate to provide the second thrust to the perforation assembly in the desired direction, or the third propulsion unit to activate to provide a third thrust to the perforation assembly in the desired direction, or a combination thereof.

7. The perforation assembly of claim 1, wherein the first propulsion unit comprises a protective structure disposed around a first impeller.

8. The perforation assembly of claim 1, wherein the first propulsion unit and the second propulsion unit comprise respective protective structures disposed around respective impellers.

9. The perforation assembly of claim 1, wherein the first propulsion unit and the second propulsion unit are configured to rotate in opposite directions to provide the thrust to the perforation assembly in the desired direction.

10. The perforation assembly of claim 1, further comprising a flow improvement structure disposed between the perforation tool and the first propulsion unit, the flow improvement structure configured to smooth fluid flow into the first propulsion unit.

11. The perforation assembly of claim 10, wherein the flow improvement structure comprises a curved cowl or a linear tapered profile having a narrow end positioned proximate the first propulsion unit and a wide end positioned proximate the perforation tool.

12. A perforation assembly comprising:

a plurality of perforation tools;

a first propulsion unit coupled to a first perforation tool of the plurality of perforation tools at a first end of the first perforation tool and configured to provide a first thrust to the perforation assembly in a desired direction;

a second propulsion unit coupled to (i) the first perforation tool at a second end of the first perforation tool, and (ii) a second perforation tool of the plurality of perforation tools at a first end of the second perforation tool, wherein the second propulsion unit is configured to provide a second thrust to the perforation tool in the desired direction; and a third propulsion unit coupled to the second perforation tool at a second end of the second perforation tool and configured to provide a third thrust to the perforation assembly in the desired direction;

wherein the first propulsion unit, the second propulsion unit, and the third propulsion unit are configured to operate independently and at the same time to provide the first thrust, the second thrust, and the third thrust, respectively, to the perforation assembly in the desired direction.

13. The perforation assembly of claim 12, comprising a controller configured to:

receive an indication of a location of the first perforation tool, or the second perforation tool, or both; and cause the first propulsion unit to activate to provide the first thrust to the perforation assembly in the desired direction, the second propulsion unit to activate to provide the second thrust to the perforation assembly in the desired direction, or the third propulsion unit to activate to provide the third thrust to the perforation assembly in the desired direction, or a combination thereof.

14. The perforation assembly of claim 12, wherein the first propulsion unit, the second propulsion unit, or the third propulsion unit, or a combination thereof, comprises a respective spacer having a respective length selected to maximize propulsive efficiency of the first propulsion unit, the second propulsion unit, or the third propulsion unit, respectively.

15. The perforation assembly of claim 12, wherein the first propulsion unit, the second propulsion unit, or the third propulsion unit, or a combination thereof, comprises a protective structure.

16. The perforation assembly of claim 15, wherein the protective structure is electrically conductive.

17. A method comprising:

receiving, via a controller, an indication of a location of a perforation tool within a well, the perforation tool being coupled to a first propulsion unit at a first end of the perforation tool and a second propulsion unit at a second end of the perforation tool; and causing, via the controller, the first propulsion unit, or the second propulsion unit, or both, to activate to provide thrust to the perforation tool in a desired common direction, wherein the first propulsion unit and the second propulsion unit are each configured to operate independently and at the same time to provide the thrust to the perforation tool in the desired common direction.

18. The method of claim 17, wherein the perforation tool is a first perforation tool, wherein the second propulsion unit is coupled to a second perforation tool, wherein the second perforation tool further comprises a third propulsion unit coupled to the second perforation tool and configured to provide additional thrust to the second perforation tool, and wherein the first propulsion unit, the second propulsion unit, and the third propulsion unit are independently operable.

19. The method of claim 18, wherein the thrust comprises a first thrust associated with the first propulsion unit and a second thrust associated with the second propulsion unit, the method comprising:

receiving, via the controller, a second indication of a second location of the second perforation tool within the well; and causing, via the controller, the first propulsion unit, the second propulsion unit, or the third propulsion unit, or a combination thereof, to activate to provide the first thrust associated with the first propulsion unit, or the second thrust associated with the second propulsion unit, or the additional thrust associated with the third propulsion unit, or any combination thereof, to the second perforation tool.

20. The method of claim 17, wherein the controller is configured to receive the indication of the location of the perforation tool from one or more sensors configured to monitor the location of the perforation tool.

* * * * *